US006141201A

United States Patent [19]

Schmitz

[11] Patent Number: 6,141,201

[45] Date of Patent: Oct. 31, 2000

[54] METHOD OF REGULATING THE ARMATURE IMPACT SPEED IN AN ELECTROMAGNETIC ACTUATOR BY ESTIMATING THE REQUIRED ENERGY BY EXTRAPOLATION

[75] Inventor: Günter Schmitz, Aachen, Germany

[73] Assignee: FEV Motorentechnik GmbH & Co. Kommanditgesellschaft, Aachen, Germany

[21] Appl. No.: 09/261,461

[22] Filed: Feb. 24, 1999

[30] Foreign Application Priority Data

Feb. 25, 1998 [DE] Germany ..... 198 07 875

[51] Int. Cl.[7] ..... H01H 47/04

[52] U.S. Cl. ..... 361/154; 361/160

[58] Field of Search ..... 361/143, 146, 361/152, 154, 153, 155, 156, 160

[56] References Cited

U.S. PATENT DOCUMENTS 4,720,763 1/1988 Bauer ..... 361/154

5,784,244 5/1999 Moran et al. ..... 361/154

5,905,625 5/1999 Schebitz ..... 361/154

*Primary Examiner*—Michael Sherry

*Attorney, Agent, or Firm*—Venable; Gabor J. Kelemen

[57] ABSTRACT

A method of regulating an electromagnetic actuator is disclosed. The electromagnetic actuator has an electromagnet; an armature movable, in a switching step, by a controlled current supply to said magnet coil, from a first armature position to a second, pole face-engaging armature position against a force of a resetting spring. The method includes the following steps for regulating the current flow through the magnet coil to set a low velocity of the armature as it arrives at the pole face: during the switching step, detecting the energy amount in the electromagnetic actuator by detecting a changing armature position and/or a changing armature velocity; estimating by extrapolation the expected energy amount upon arrival of the armature on the pole face; and forming a coarse correcting value by comparing the estimation to be extrapolated with a predetermined target value selected with an aid of the total energy stored in the system in the second armature position.

25 Claims, 6 Drawing Sheets

METHOD OF REGULATING THE ARMATURE IMPACT SPEED IN AN ELECTROMAGNETIC ACTUATOR BY ESTIMATING THE REQUIRED ENERGY BY EXTRAPOLATION

CROSS REFERENCE TO RELATED APPLICATION

This application claims the priority of German Application No. 198 07 875.7 filed Feb. 25, 1998, which is incorporated herein by reference.

BACKGROUND OF THE INVENTION

Electromagnetic actuators which essentially comprise at least one electromagnet and an armature which is connected with a setting member to be moved and which is displaceable against the force of a resetting spring by electromagnetic forces upon energization of the electromagnet are characterized by a high switching speed. These structures, however, involve the problem that as the armature approaches the pole face of the electromagnet and thus the air gap between the pole face and the armature decreases, the electromagnetic force acting on the armature progressively increases, while the counter force of the resetting spring, as a rule, only linearly increases. As a result, the armature impacts on the pole face with an increasing speed. Apart from noise generation, rebound may occur, that is, the armature first impacts on the pole face and then, at least for a short period of time, lifts off until it eventually assumes its position of rest on the pole face. This phenomenon may lead to an unsatisfactory operation of the setting member which, particularly in actuators of high switching frequency, may lead to significant disturbances.

It is therefore a desideratum that the impact velocity be in the order of magnitude of under 0.1 m/s. It is of importance in this connection that such small impact velocities should be ensured under real operational conditions including all stochastic fluctuations involved therewith. External interfering effects, for example, shocks or the like may, in the terminal approaching phase or even after engagement of the armature against the pole face, lead to a sudden drop of the armature from the pole face.

SUMMARY OF THE INVENTION

It is an object of the invention to provide an improved regulating method of the above-outlined type which, in electromagnetic actuators of the discussed kind, can control in such a manner the motion of the armature as it approaches the pole face that the armature arrives into engagement with the pole face with a low impact velocity while, nevertheless, a sufficiently high holding force subsequent to the impacting of the armature on the pole face is ensured.

This object and others to become apparent as the specification progresses, are accomplished by the invention, according to which, briefly stated, the method of regulating an electromagnetic actuator which has an electromagnet and an armature moved thereby against a resetting spring force includes the following steps for regulating the current flow through the magnet coil to set a low velocity of the armature as it arrives at the pole face of the electromagnet: during the armature travel towards the pole face, detecting the energy amount in the electromagnetic actuator by detecting a changing armature position and/or a changing armature velocity; estimating by extrapolation the expected energy amount upon arrival of the armature on the pole face; and forming a coarse correcting value by comparing the estimation to be extrapolated with a predetermined target value selected with an aid of the total energy stored in the system in the second armature position.

The method according to the invention takes advantage of the fact that up-to-date electronic computing modules have a high computing speed and thus it is possible to determine not only during the switching process the momentary position and/or displacement velocity but also to detect the motion processes in a plurality of actuators. It is further feasible to process the required motion values and in case of deviations to ensure for each individual actuator, by means of an appropriate regulation, an optimal course for each individual switching cycle for each actuator. By practicing the invention advantage is taken of the fact that by determining intermediate magnitudes of the armature motion and by taking into account known or measurable disturbance factors, the expected energy amount of the system may be in advance estimated by extrapolation for the moment of impacting, so that by means of a suitable regulator the current supply of the "capturing" electromagnet and thus the magnetic energy feed may be controlled such that the armature arrives at the pole face with an impact velocity which is only slightly above the ideal impact velocity of zero.

DESCRIPTION OF THE PREFERRED EMBODIMENT

Figure 1:
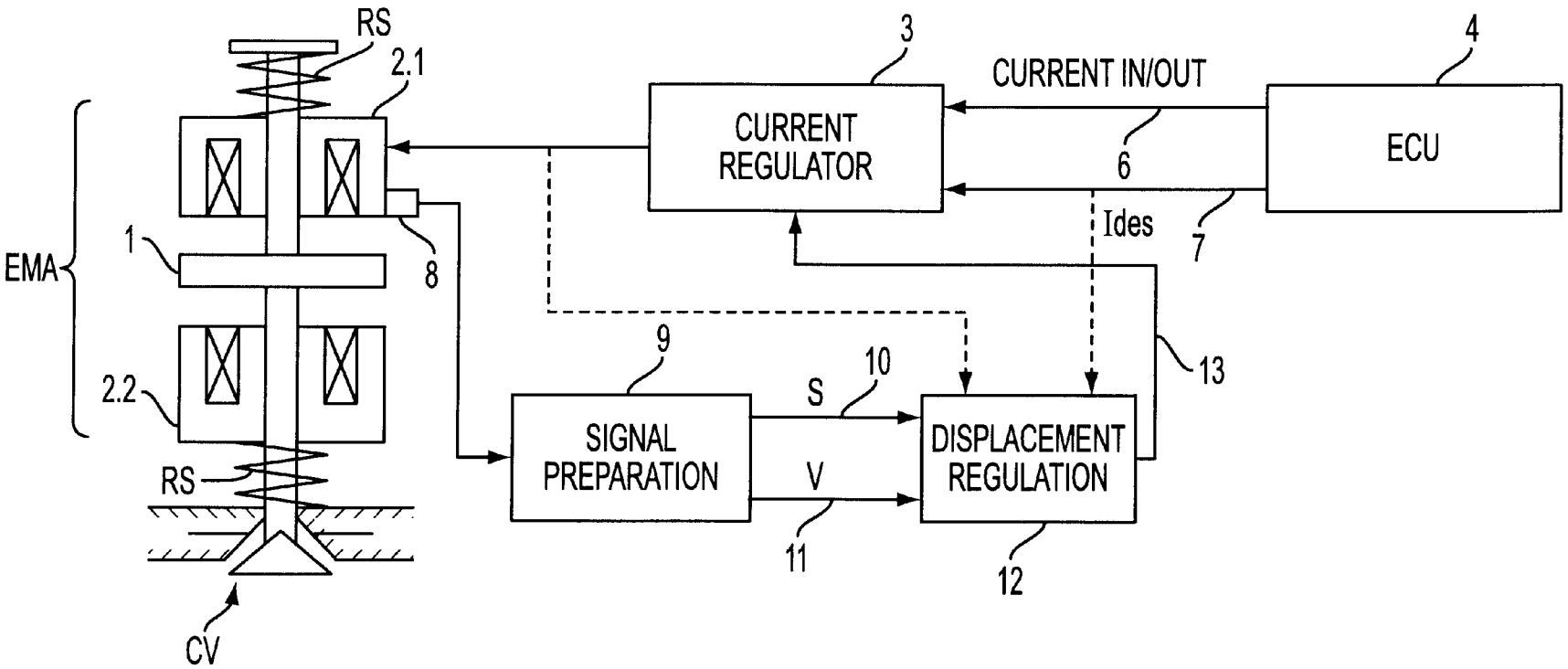
FIG. 1 is a schematic side elevational view of an electromagnetic actuator and a block diagram of the circuitry for performing the control method according to the invention.

FIG. 1 schematically illustrates a cylinder valve CV of a piston-type internal-combustion engine provided with an electromagnetic actuator EMA as the valve drive. The actuator EMA essentially comprises a closing magnet 2.1 and an opening magnet 2.2 between which an armature 1 is guided for reciprocating motion against the force of schematically illustrated resetting springs RS in accordance with the current supply to the electromagnets 2.1 and 2.2. The two end positions of the cylinder valve CV which constitutes a setting member are defined by the position of the armature 1 at the one and the other electromagnet 2.1 and 2.2.

In FIG. 1 the armature 1 is shown in its intermediate position after it has been moved by the force of the associated return spring RS towards the direction of the closing magnet 2.1 subsequent to the de-energization of the opening magnet 2.2.

In the description which follows the regulating process for the current supply of the closing magnet 2.1 will be set forth.

It is noted that the control of the current supply for the opening magnet 2.2 is effected in the same manner. The motion process of the armature 1 is controlled by the electromagnet 2.1. The current is taken from a current regulator 3 which, in turn, receives commands for the current supply from an engine control unit (ECU) 4. At least the switch-off signals for the current 6 are applied to the current regulator 3. A desired current value 7 may be predetermined by the engine control unit 4, for example, in dependence of the operating point of the engine.

In a measuring device (sensor) 8 a signal representing the armature motion is detected. The signal, after evaluation by a signal preparing device 9, is made available as a displacement (path) signal 10 and a speed signal 11 for the displacement regulating unit 12 proper. The displacement regulating unit 12 generates a correction signal (coarse correction signal) 13. The signals 10 and 11 need not reflect necessarily exactly (for example, linearly) the path or the speed; rather, in each instance, a signal suffices which contains a representative information concerning the path and the speed. For example, a measuring device may be used which outputs the path signal in a non-linear manner, thus, which in the close vicinity of the armature to the end position (pole face) has a greater path dependence than in case of a more remotely located armature.

In general, different measuring devices may be used, even an estimation of the path and speed information from the current and voltage course is feasible. In such a procedure the fact is utilized that the voltage across the magnet coil has a path and speed-dependent component: The coil voltage has, apart from the voltage drop by the resistive resistance of the coil ($U_R$=I*R), a voltage component based on the current change ($U_L$=L*dI/dt), in which the inductivity L is dependent from the position of the armature, so that a voltage signal based on the field change caused by the approach of the armature and a counter voltage resulting therefrom may be sensed.

Further, however, the relationship between the path and the speed is known since based on the laws of physics, the speed is derived from the displacement/time function. As a result, conclusions may be drawn concerning displacement and position by means of the two known relationships.

A result concerning the exact values for the path (displacement) and speed may also be obtained with an overall model (differential equations v=ds/dt and a=dv/dt as well ΣF=m*a) with the known values for the mass of the armature, the stiffness of the springs, etc.

Figure 2:
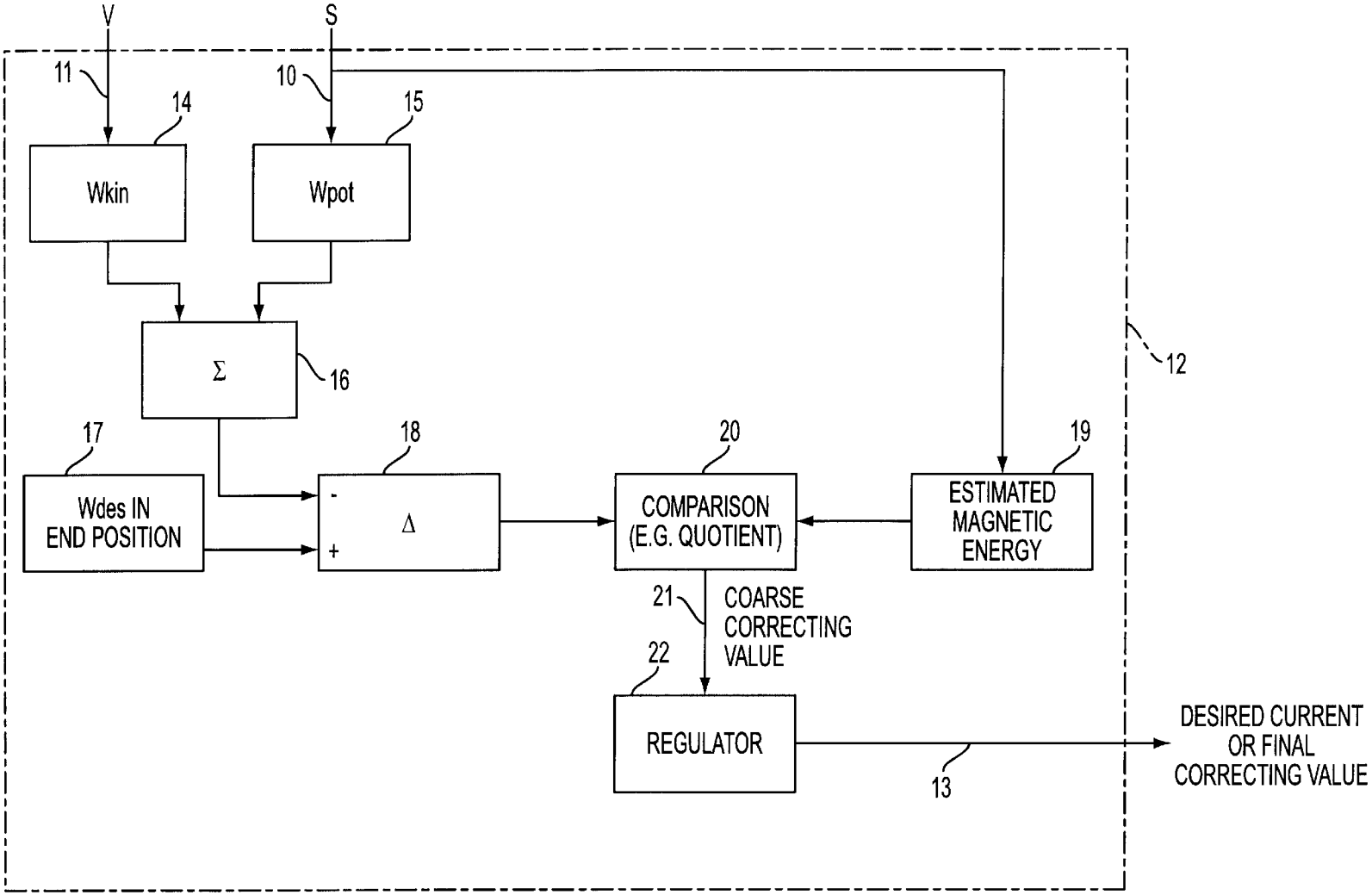
FIG. 2 is a block diagram illustrating the basic components of a regulating circuit.

The utilization of the values for the speed and the path information (position of the armature) in the path regulating unit 12 will be discussed in conjunction with the circuit which is illustrated in FIG. 2 and which contains additional circuit elements. It is noted that the reference numerals for the switching elements simultaneously designate the outputted signals.

First the potential energy of the armature is calculated in a computing unit 15 from the path information 10 by determining the energy stored in the springs. For this purpose, for example, first the position of rest of the armature is subtracted from the measured armature position. The stored energy is then obtained from this magnitude which is raised to the second power and is multiplied by one half of the spring stiffness resulting from the participating springs. Thus, in the formula $W_{pot}=\frac{1}{2}cx^2$, the multiplier is $x=s+V_S/2$, where s is the momentary distance from the pole face, $V_S$ is the valve stroke and the position of rest of the armature is in the middle between the magnets. This example does not take into account the valve clearance. Instead of the path information a force information may be utilized because the force may be expressed as the displacement as a function of the spring stiffness c. Thus, for example, the force information which may be detected, for example, by piezoelectric wafers positioned at the valve springs, may be used instead of the path information. From these data too, in principle, a velocity information may be derived.

The information concerning the velocity 11 which may be derived from the path information, for example, by means of differentiation, is utilized for computing the momentary kinetic energy in a computer 14. The computation is based on the formula $W_{kin}=\frac{1}{2}mv^2$ wherein m is the moved mass which is composed of the mass of the armature, the armature pin, the valve as well as the reduced (participating) mass of the springs. The determination of the armature position and velocity may also be effected by first measuring the velocity and then the path is determined by integration.

The energy values obtained in the above-described manner are added in an adder 16 and thereafter are subtracted in a difference former 18 from the energy 17 ($W_{des}$) required for the terminal position. In a strictly symmetrical system such an energy would be equal to the initial potential energy. Otherwise, the corresponding value may be calculated in the usual manner, that is, in case of a linear spring, from $W_{des}=\frac{1}{2}cx^2$ wherein $x=s-V_s/2$. In case of non-linear springs, the value has to be determined by forming the integral of the force/path function, that is, $$W_{des} = \int_{\text{position of rest}}^{\text{end position}} F_{spring} ds$$

(starting from the position of rest to the end position)

As a result of the subtraction performed in the difference former 18 the target value for the energy is obtained which is still required to ensure that the armature reaches its end position at all.

In contrast, in a computing block 19 it is estimated by extrapolation how much energy, based on the magnetic force, has still to be supplied to ensure that the armature reaches its terminal position. This computation is performed based on the knowledge of the force/path function. Thus, the magnetic force/path function is integrated, starting with the actual position until the end position:

$$W_{magn} = \int_{\text{actual position}}^{\text{end postion}} F_{Magnet} ds.$$

As a "terminal position" there also may be meant the position of the armature when the valve assumes its seated position in case a valve clearance is present.

In case such an energy is less than the actually required energy determined in the difference former 18, the current flowing through the magnets has to be increased to thus increase the magnetic energy. This may be effected by forming, in a comparator 20, a quotient of the required energy determined in the difference former 18 and the magnetic energy estimated by extrapolation in the computing block 19. Such a quotient which is designated as a coarse correcting value 21 is, in case the energies are equal, by nature equal to 1 and thus no correction is required. In case of a quotient which is smaller than 1 the magnetic energy to be expected is excessive and accordingly the current has to be corrected by reduction. In case of a quotient which is greater than 1, the magnetic energy to be expected is insufficient so that the current has to be increased.

As an alternative to forming a quotient, a difference forming may be considered. In such a procedure then the positive values for the coarse correcting value 21 correspond to an expected insufficient magnetic energy, that is, the current must be increased, whereas negative values correspond to an expected excessive magnetic energy, that is, the current must be reduced.

The amount required for the current increase or current decrease is determined by a block 22 designated as a "regulator". The regulator may be a conventional PID regulator for using the difference as the coarse correcting value 21. The P-component yields the multiplier with which the correcting value 21 is multiplied to obtain the desired magnitude for the current increase or decrease. An I-component (integral component) may be introduced to compensate for deviations appearing during displacements of substantial length. If an increased friction is present then, for example, the I-component may significantly improve the quality of regulation. A D-component (differential component) serves for a rapid elimination, by regulation, of disturbances in the course of displacement and also serves for the compensation of an integral behavior occurring in the regulation, caused, for example, by the inductivity of the magnet coil. It is to be understood that regulators other than a PID regulator may be also be used. For example, with the known "deadbeat" regulators favorable properties may be obtained.

The regulator has to be designed differently in case a quotient, rather than a difference, is formed in the comparator 20. A greater-than-1 P-component of a conventional PID regulator would augment a correction factor less than 1 above the value of 1 by multiplication, so that instead of a desired reduction of the current, a current increase would occur. This circumstance is remedied by an exponential formation. Thus, the coarse correcting value 21 is not multiplied with the "P" factor but raised to that power so that, for example, in case of a "P" factor of 2 which was found to be favorable, the coarse value is squared. In this manner, the amplification of regulation is increased in accordance with the conventional PID regulator. In such a case too, additionally suitably computed integral and differential components may be formed. In case of the I-component, for example, the deviation of the value from 1 is integrated and added to the P-component or is accordingly multiplied after the addition of 1.

In both methods (that is, quotient formation and difference formation) a limitation of the correcting value occurs. In case of a quotient formation a downward limitation to a value of between 0.1 and 0.3 and an upward limitation to a value of between 2 to 3 have been found. The respective values are, to be sure, also dependent from the initial magnitudes of the currents for estimating the magnetic energy.

Figure 3:
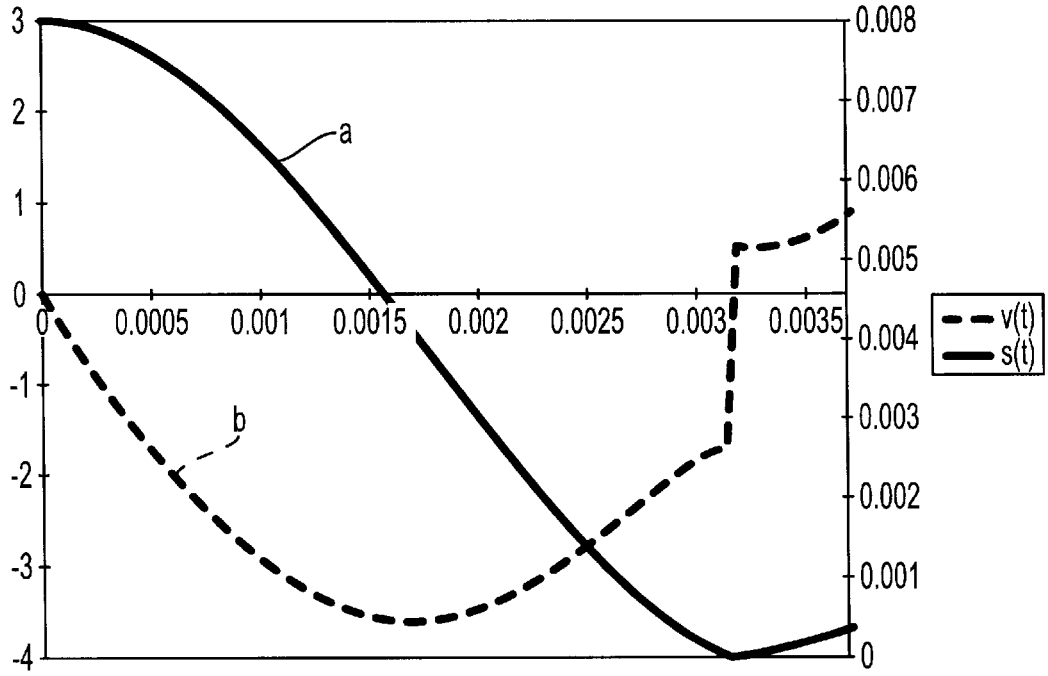
FIG. 3 is a diagram showing the course of displacement and velocity of the actuator armature as a function of time without regulating the current supply.
Figure 4:
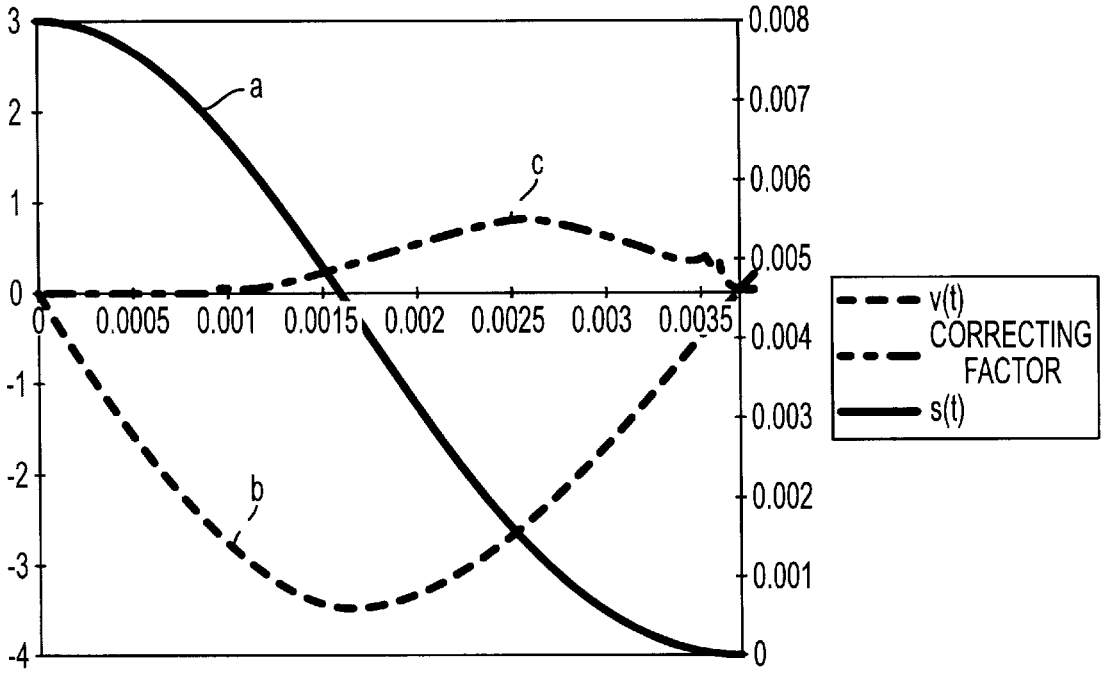
FIG. 4 is a diagram showing the course of displacement and velocity of the actuator armature as a function of time with a current supply regulation according to the invention.

FIG. 3 shows a displacement curve a) and a velocity curve b) without regulation, while FIG. 4 shows the same variables with regulation. A comparison of FIG. 4 with FIG. 3 shows a "gentler" displacement curve a) when regulation is effected. At the moment when the armature reaches its end position, the velocity with regulation is less than 0.1 m/s, while without regulation the impact velocity is approximately 2 m/s. The latter value may be, to be sure, improved by "manual optimization", thus lowering the current to the cutoff limit, but even with such a procedure, values of less than 0.3 m/s can be achieved only with difficulty, if at all. Further, without regulation the problem is encountered that in case of changes in the friction or merely because of cyclic fluctuations in the combustion process of the engine, values for the current have to be set which under all circumstances ensure a secure capture of the armature at the pole face of the magnet. Normally such values are significantly overdimensioned, so that the armature is excessively accelerated and thus has a high impact velocity.

FIG. 4, in addition to the displacement curve a) and the velocity curve b), shows the curve c) of the correction factor as a function of time. It is seen that after an initial estimation the correction factor is first held at zero value, thereafter it approaches 1 and then drops again in the terminal curve portion.

Figure 5:
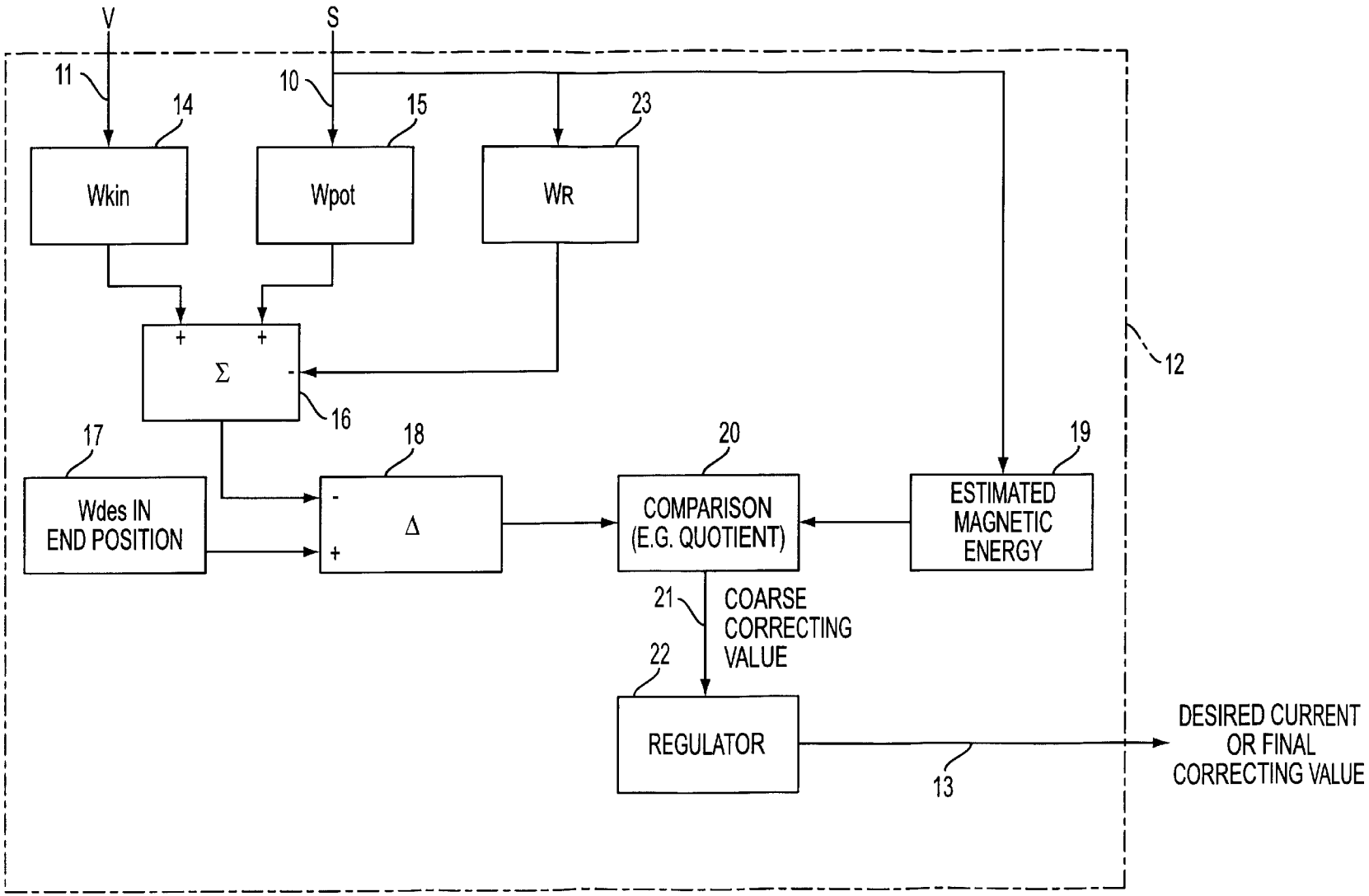
FIG. 5 is a block diagram similar to FIG. 2, taking losses into account.

The initial "mis-estimation" that the current has to be regulated to zero value originates from the assumption that at the beginning the energy contained in the system would, neglecting losses during the motion, in fact suffice for ensuring that the armature arrives at the pole face. This effect may be avoided by introducing a further estimated value. For this purpose, for example, an energy value is considered which may be expected for overcoming losses, for example, frictional losses, until the armature reaches its terminal position. For this purpose, in the circuit according to FIG. 2, as shown in FIG. 5, a further (negative) addendum 23 is applied to the adder 16 which takes into account the expected losses as a function of the momentary position of the armature. Such an energy may be computed from the estimated velocity course which is approximately sinusoidal in case of small friction values. In this manner, a cosine function may be assumed as the integral, whose maximum value is a magnitude which is lost in a complete motion course and which is designated hereafter as ($W_{frictionsum}$).

If s is the path of the valve stroke VS until zero, then:

$$W_R(S) = W_{frictionsum}\left(1 + \cos\left(\pi \cdot \frac{S}{VS}\right)\right)\Big/2$$

It has been found that a linear dependency too, yields a significant improvement of the regulation, thus, $$W_R(S) = W_{frictionsum} \cdot \frac{S}{VS}.$$

It is to be understood that it is just as feasible to apply the computed frictional energy to the difference former 18 as a positive addendum. This is mathematically equivalent to what was described above.

Figure 6:
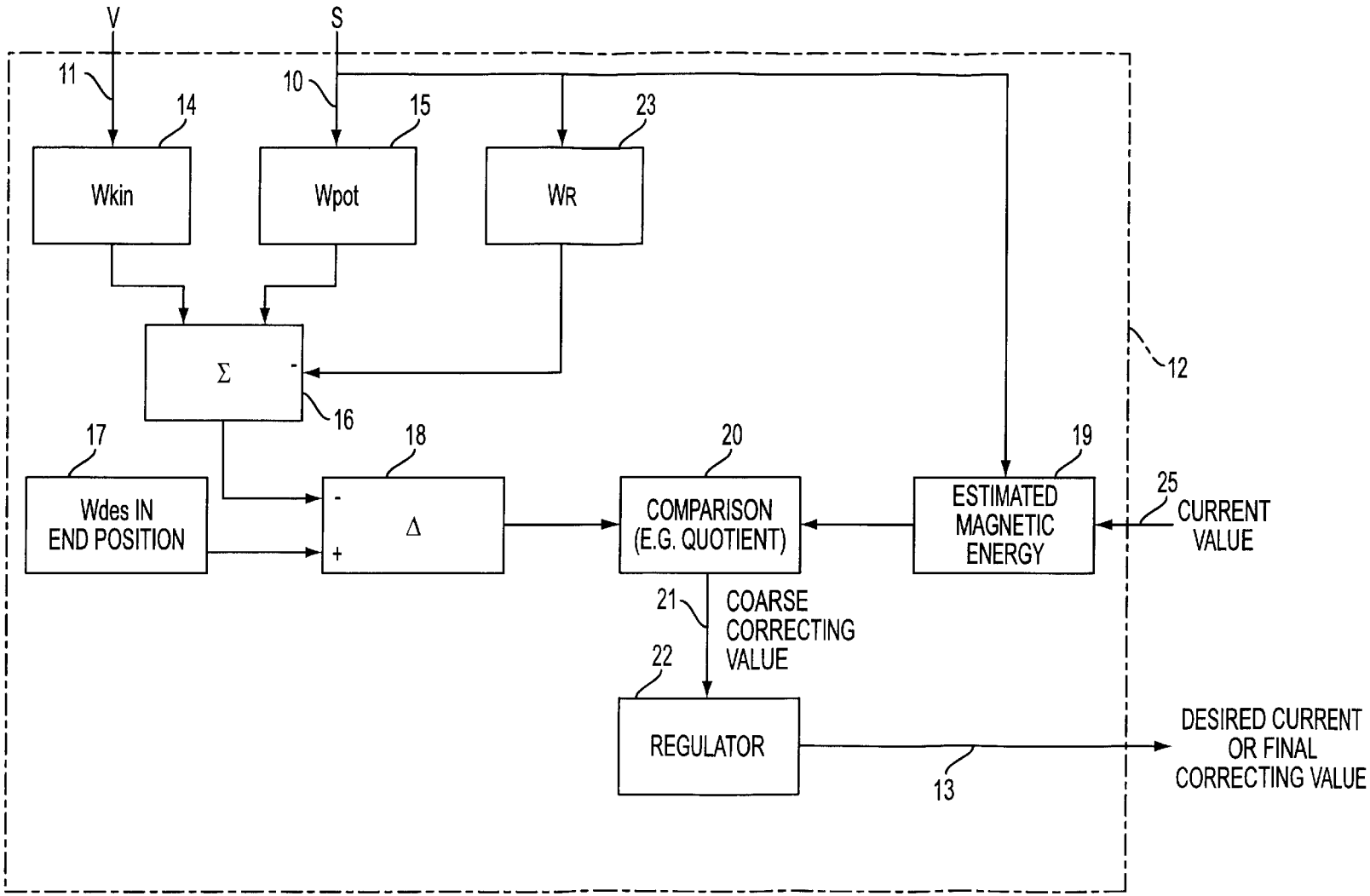
FIG. 6 is a block diagram according to FIG. 5, further taking into account the respective current intensities.

All the above-described energy computations may also be performed in advance instead of an "on-line" computation, for example, by suitable measurements at an "original actuator". It is then possible to store these results (thus, for example, the results of the integral computation) as a data table (characteristic field) in a memory (for example, EPROM). In such a case the complexity of computation is simplified to a characteristic field access which may be performed even without a processor; for example, merely the value available in analog form needs to be converted into digital form (A/D conversion). The obtained digital magnitude may then be immediately used as an address for an EPROM, whereby the complexity of computation may be significantly reduced. Such tables, however, may be used not only for the energy determination in the elements 14, 15, 17, 19 and 23: the regulator proper may contain such tables in order to formulate the PID-components in a non-linear manner. A limitation to a minimum and maximum correction value may also be effected. When using a characteristic field, tables with two input magnitudes, that is, displacement and velocity, may be partially or even entirely combined, in which case a "characteristic field regulation" is obtained. The computing block 19 may contain a simple function or characteristic curve for the magnetic energy to be estimated by extrapolation; a constant current is assumed. In the alternative, however, a characteristic field or a curve set for each different current intensity may be stored. In such a case as a further input for the computing block 19 an actual current value 25 is used as shown in FIG. 6 which originates either from the desired input value 7 of the control device 4 or as an output value of the current regulator 3 or as a measured value of the current passing through the magnet coil.

Particularly in combination with a pre-given value of the desired current according a current course considered as optimal, the computing block 19 may consist of a stored curve, that is, a curve for the optimal course. Such an optimal curve may be determined iteratively, that is, by repeated tests. For this purpose, first, for example, a constant current is assumed as the "optimal curve 0" with which then the actuator is driven together with the regulator and thus an optimized current course as "optimal curve 1" is plotted. This is repeated until no more significant improvements are obtained.

The correction value 13 may be used as the new desired current value as a factor or as an addendum for the alteration of the current. To the above-described "displacement regulator" a current regulator is subordinated which measures the current flowing through the solenoid and sets the desired current value determined or influenced by the displacement regulator.

As an alternative, a separate current regulator may be dispensed with. In such an arrangement the displacement regulator affects solely the voltage of the solenoid.

To securely capture the armature, towards the end of its travel the current may be switched to a predetermined higher value as a function of the armature position. As a criterion for such a high current level a minimum current may be taken which is needed to apply a magnetic force which overcomes the spring force.

After the armature has reached its terminal position, an automatic switchover to the holding current may occur.

The described system for the displacement regulation or for the reduction of the impact velocity of the armature or that of the cylinder valve at its seat may be significantly further improved, particularly as concerns the appearance of more significant motion losses, by forcing an operation of the regulator basically on the "safe" side. If this does not occur, it is likely that the armature "starves" that is, it is no longer capable of reaching the pole faces of the respective capturing magnet and a sufficient energy supply will no longer be effective. Such a problem is encountered mostly in the exhaust valves of internal-combustion engines, where the exhaust valves have to execute their opening motions against high gas forces. The improvement which will now be described may, however, also find application with intake valves of the cylinder.

Figure 7:
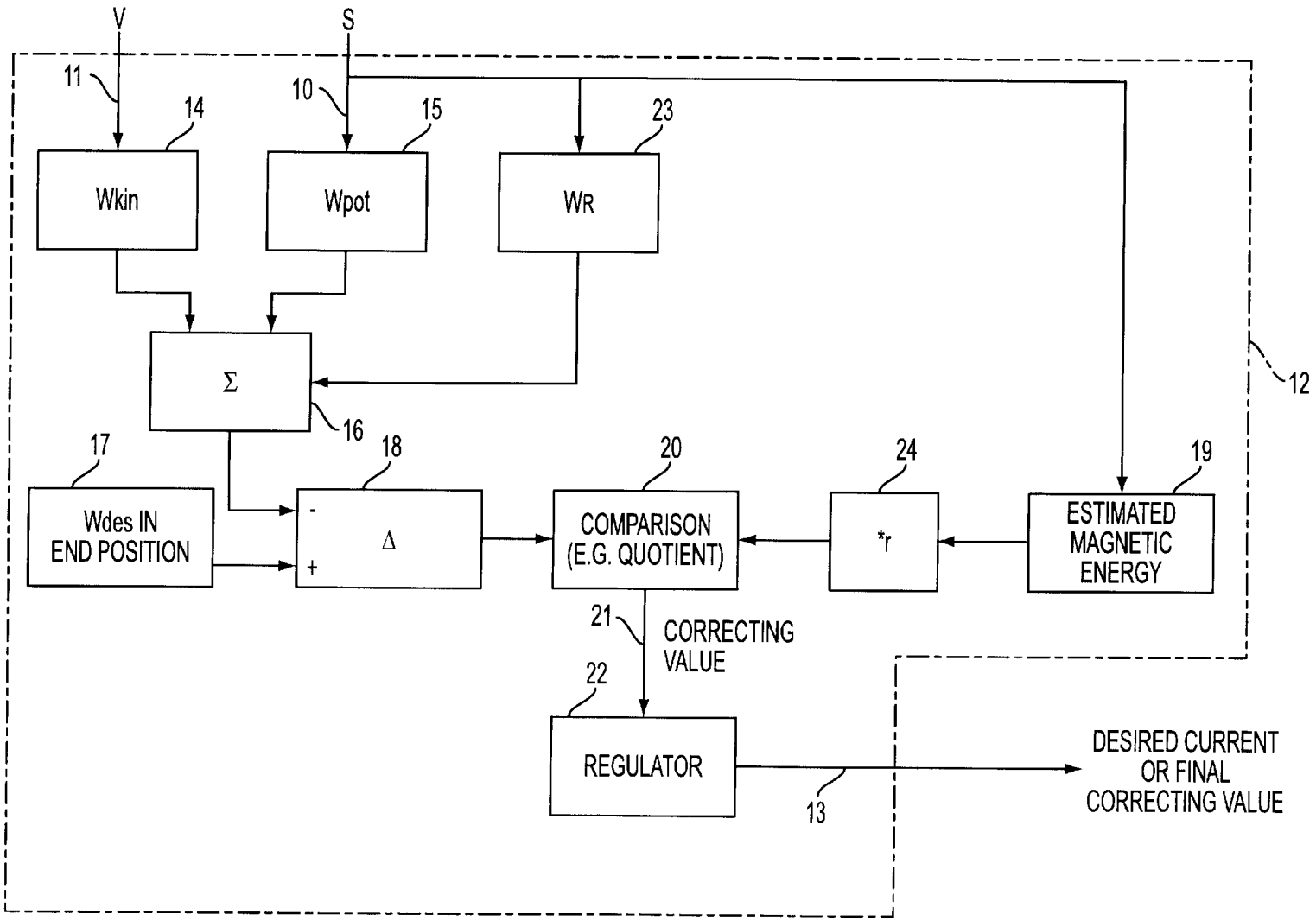
FIG. 7 is a block diagram according to FIG. 5, taking into account a reduction factor for the magnetic energy requirement estimated by extrapolation.

In such an improvement it has to be ensured that the energy supply estimated by extrapolation is always assumed to be insufficient, so that eventually always more energy is supplied than in the process described above. For this purpose the magnetic energy estimated by extrapolation is, by multiplying it with a reduction coefficient "r", diminished by a reduction factor as shown at 24 in FIG. 7. In this manner the sought-after effect is achieved: the farther away the armature from its location of impact, the greater the effect because at that such remote location the energy increase to be expected is even greater. Towards the end of the armature motion the effect progressively decreases in magnitude so that the regulator in fact reaches the desired target. One is, however, compelled to perform the approach from the side of an energy excess. As a magnitude for the reduction factor values between 0.3 and 0.6 have been found to be well suited in most cases. With smaller values the capturing process may be more securely ensured, with larger values the impact speed is maintained at a smaller value. Therefore an adaptation of the correcting factor to the operating point of the engine is expedient: in case of low loads and small rpm's where only low noises are experienced, the effect of the combustion on the oscillations in the damping of the actuator motion is small and therefore a larger value is more favorable. In contrast, in case of large loads and high rpm's where the impact noise of the armature and valve is substantial and thus the impact speed is of lesser significance, the reliability of motion is endangered because of the greater fluctuations of the frictional effects on the moving parts of the actuator and therefore in such a case smaller values are appropriate.

A complementation of or an alternative to the above-described reduction coefficient offers a more accurate estimation of the further course of armature motion. For calculating the estimated computing block 19 as well as the estimated friction (addendum 23) as a final value of the integration (upper value of the integral), not the terminal position but the entire further motion course of the armature is used. Accordingly, for the respective comparison not the potential desired energy in the end position is calculated, but that in the respective precalculated position of the motion course. It may be estimated therefrom whether in case of the selected current intensity every position may be reached by the armature from the point of view of energies.

Let it be assumed that a computation of the magnetic energy determines that in the last quarter of the motion path 90% of the entire magnetic energy would be applied. The armature, however, because of outer influences of the gas outflow phenomena at the valve would be as early as in the first half of its displacement, braked in such a manner that the initially available energy would already be reduced by 40%. Since for up to this part of the motion path only 10% of the magnetic energy would be applied, the armature could never reach a position from which the remaining 90% of the energy would be applied. This circumstance notwithstanding, the displacement regulator 12 (without reduction coefficient) described earlier in connection with FIG. 2, would start out at least from a sufficient energy and would not prematurely increase the current to thus prevent the armature from "starving".

By means of an estimation by extrapolation over the entire motion path, this problem, however, may be recognized in time and thus compensated for by a counter regulation (premature current increase).

As soon as the arrival of the armature 1 at the pole face of the electromagnet 2.1 has been detected, for example, by means of a measuring device 8, the engine control 4 or, as the case may be, the current regulator 3 supplies the electromagnet with a current whose intensity corresponds to that of the required holding current. In some instances the latter may be cycled between an upper and a lower holding current level.

In complementation, as armature arrival at the pole face is recognized, it is feasible to increase the current for a short period of time beyond the holding current level before the current is regulated to the holding current level in order to prevent an accidental liftoff of the armature from the pole face, caused by outer influences, such as shocks or vibrations.

As an alternative to using a conventional PID regulator it is to be understood that a regulator may be used which, for an optimal regulation, also takes into account that part of the regulation which has not been considered theretofore. By virtue of the inductivity of the solenoid as well as eddy currents, the maximum increase of the magnetic force is limited. This behavior may be described by a model and may be taken into account in the regulator.

An alternative to the respective complete integral formation concerning the magnetic energy is a replacement of the integration variable ds by the integration variable dt. Therefore, the integral $\int F_{magnet} ds$ into $\int (F_{magnet} V) dt$. If the integration limits are accordingly set then the extrapolated magnetic energy may be expressed by $$W_{magn} = \int_{\text{Actual position}}^{\text{End position}} F_{magnet} ds = \int_{\text{Initial position}}^{\text{End position}} F_{magnet} ds - \int_{\text{Initial moment}}^{\text{Terminal moment}} (F_{magnet} V) dt$$

The advantage resides thus in the fact that the integral $(F_{magnet} V)dt$ may be continuously formed by an integrator which integrates over time. Technically such an integrator may be realized in a significantly simpler manner. The integral $$\int_{\text{Initial position}}^{\text{End position}} F_{magnet} ds$$

may be calculated in advance and may be made available as a constant for the process.

It will be understood that the above description of the present invention is susceptible to various modifications, changes and adaptations, and the same are intended to be comprehended within the meaning and range of equivalents of the appended claims.

What is claimed is:

1. A method of regulating an electromagnetic actuator having an electromagnet provided with a pole face and having a magnet coil; an armature movable, in a switching step, by a controlled current supply to said magnet coil, from a first armature position to a second, pole face-engaging armature position against a force of a resetting spring; the method comprising the following steps for regulating the current flow through the magnet coil to set a low velocity of the armature as it arrives at the pole face:

(a) during the switching step, detecting the energy amount in the electromagnetic actuator by detecting at least one of a changing armature position and a changing armature velocity;

(b) estimating by extrapolation the expected energy amount upon arrival of the armature on the pole face; and (c) forming a coarse correcting value by comparing the estimation to be extrapolated with a predetermined target value selected with an aid of the total energy stored in the system in said second armature position.

2. The method as defined in claim 1, wherein step (c) comprises the step of forming said coarse correcting value by forming a quotient from said target value and said energy amount arrived at in step (b).

3. The method as defined in claim 1, wherein step (c) comprises the step of forming said coarse correcting value by forming a difference between said target value and said energy amount arrived at in step (b).

4. The method as defined in claim 2, further comprising the step of forming a fine correcting value by raising said coarse correcting value to one of the second and third power.

5. The method as defined in claim 3, further comprising the step of forming a fine correcting value by multiplying said coarse correcting by a factor of between 2 and 5.

6. The method as defined in claim 1, further comprising the steps of forming a fine correcting value from said coarse correcting value and limiting one of said coarse and fine correcting values to predetermined minimum and maximum values.

7. The method as defined in claim 1, further comprising the step of forming an adaptation value for improving an estimated value for an energy supply in an actual switching cycle by comparing the value obtained in step (b) with an expected magnetic energy supply value based on an actual current supply of the electromagnet and by detecting losses in at least one switching cycle.

8. The method as defined in claim 1, further comprising the step of coupling a setting member with a clearance to said armature for causing motions of said setting member by said armature upon displacement of said armature; further wherein step (b) comprises the step of computing an effect of said clearance by determining a momentary kinetic energy based on moved masses of said electromagnetic actuator and the armature velocity and by determining, from an actual position of the armature relative to the pole face, the momentary potential energy of said resetting spring.

9. The method as defined in claim 1, wherein step (a) comprises the step of determining the position of said armature by detecting and integrating the magnitude of displacement velocity thereof.

10. The method as defined in claim 1, wherein step (a) comprises the step of determining the armature velocity by detecting momentary positions of the armature and forming a derivation according to time.

11. The method as defined in claim 1, wherein step (a) comprises the step of determining at least one of the armature position and the armature velocity by detecting a course of voltage drop across and current flow through the magnet coil.

12. The method as defined in claim 1, further comprising the step of adapting detected values of at least one of the armature position and armature velocity by means of measuring values determined by comparative measurements performed on a model and concerning a function of armature displacement and armature velocity with respect to time.

13. The method as defined in claim 1, further comprising the step of multiplying a value obtained in step (b) by a reduction factor of between 0.2 and 0.9.

14. The method as defined in claim 1, further comprising the step of multiplying a value of the magnetic energy, estimated by extrapolation, by a reduction factor of between 0.2 and 0.9.

15. The method as defined in claim 1, further comprising the step of performing a current supply to said magnet coil by a PID regulator and treating the P-component thereof as an exponential value.

16. The method as defined in claim 1, further comprising the steps of forming a fine correcting value from said coarse correcting value and obtaining a desired value by multiplying with one of the coarse correction value and the fine correction value for regulating the intensity of the current to be supplied to said magnet coil for affecting a further course of armature motion.

17. The method as defined in claim 1, further comprising the steps of forming a fine correcting value from said coarse correcting value and obtaining a desired value by one of addition and subtraction of one of the coarse correction value and the fine correction value for regulating the intensity of the current to be supplied to said magnet coil for affecting a further course of armature motion.

18. The method as defined in claim 1, further comprising the step of pre-calculating by extrapolation an expected magnetic energy supply by the electromagnet at a predetermined constant course with a current of predetermined intensity.

19. The method as defined in claim 1, further comprising the step of pre-calculating by extrapolation an expected magnetic energy supply by the electromagnet in accordance with a set current value.

20. The method as defined in claim 1, further comprising the step of pre-calculating by extrapolation an expected magnetic energy supply by the electromagnet by means of a predetermined current course considered as optimal.

21. The method as defined in claim 1, further comprising the step of determining an expected magnetic energy supply by the electromagnet by continuously integrating a force, acting on the armature, as a function of the armature displacement in a given switching step until the armature reaches said second switching position.

22. The method as defined in claim 1, further comprising the step of pre-calculating an expected magnetic energy supply by the electromagnet by accessing predetermined values of a function of the energy and the position of the armature relative to the pole face; said predetermined values being stored as a characteristic field.

23. The method as defined in claim 1, further comprising the step of pre-calculating an expected magnetic energy supply by the electromagnet by extrapolation dependent on predetermined values of courses of one of the kinetic energy and the potential energy; said predetermined values being stored in a characteristic field.

24. The method as defined in claim 1, further comprising the step of switching the current flowing through said coil to a holding current intensity when said armature reaches said second armature position.

25. The method as defined in claim 1, further comprising the step of increasing the intensity of the current flowing through said coil immediately before said armature reaches said second armature position.

* * * * *